US009782815B2

(12) United States Patent
Sallade et al.

(10) Patent No.: US 9,782,815 B2
(45) Date of Patent: Oct. 10, 2017

(54) TOOLING AND METHOD FOR DRAWING AND FLANGING A PROTOTYPE PART

(71) Applicant: Ford Motor Company, Dearborn, MI (US)

(72) Inventors: Timothy Sallade, Oxford, MI (US); John Lowery, White Lake, MI (US); Erik Riha, Dearborn, MI (US); Robert Schuh, Clarkston, MI (US); Jorge Lopez, Detroit, MI (US); Matthew Campau, Grosse Ile, MI (US); Hector Lopez, Plymouth, MI (US); Steven Church, Wixom, MI (US); Brett Cook, South Lyon, MI (US); Steven Guido, Canton, MI (US)

(73) Assignee: FORD MOTOR COMPANY, Dearborn, MI (US)

( * ) Notice: Subject to any disclaimer, the term of this patent is extended or adjusted under 35 U.S.C. 154(b) by 31 days.

(21) Appl. No.: 14/753,243

(22) Filed: Jun. 29, 2015

(65) Prior Publication Data

US 2016/0375483 A1 Dec. 29, 2016

(51) Int. Cl.
*B21D 22/20* (2006.01)
*B21D 19/08* (2006.01)

(52) U.S. Cl.
CPC ..... *B21D 22/20* (2013.01); *B21D 19/08* (2013.01)

(58) Field of Classification Search
CPC ..... B21D 19/08; B21D 5/01; B21D 37/08; B21D 37/10; B21D 22/02
See application file for complete search history.

(56) References Cited

U.S. PATENT DOCUMENTS 8,250,896 B2 * 8/2012 Hirotani ..... B21D 22/22 72/313
2015/0107321 A1 * 4/2015 Golovashchenko ... B21D 22/06 72/60

FOREIGN PATENT DOCUMENTS

| | | | |
|---|---|---|---|
| CN | 202180146 | U | 4/2012 |
| CN | 102513445 | A | 6/2012 |
| CN | 203076428 | U | 7/2013 |
| JP | S57165128 | A | 10/1982 |
| JP | H11244951 | A | 9/1999 |
| JP | 2001347319 | A | 12/2001 |
| WO | 2013132170 | A1 | 9/2013 |

* cited by examiner

*Primary Examiner* — Debra Sullivan
(74) *Attorney, Agent, or Firm* — Damian Porcari; Brooks Kushman P.C.

(57) ABSTRACT

A prototype part drawing/flanging tool is provided that are arranged in a draw die set-up and a flange die set-up. The draw die set-up includes a binder ring, a pad; a flange forming ring, and a punch. The flange die set-up includes the flanging ring, the pad, and the punch. The draw die set draws a blank and the flange die set forms a flange on the blank in two separate operations using the same die parts in the two operations. A method is disclosed for making a formed and flanged part that begins by drawing a blank held by a pad, a flanging ring and a binder ring against a punch in a press to form a drawn blank. The drawn blank is then laser trimmed to form a trimmed/drawn blank. The trimmed/drawn blank is then clamped between the pad and the punch while the flange forming ring forms a flange into a flange forming groove.

4 Claims, 4 Drawing Sheets

TOOLING AND METHOD FOR DRAWING AND FLANGING A PROTOTYPE PART

TECHNICAL FIELD

This disclosure relates to drawing and flanging prototype parts.

BACKGROUND

Prototype parts are made to facilitate confirmation of part designs for manufacturing and testing. The cost of prototype tooling is a substantial portion of the cost of developing new vehicles. One of the problems addressed by this disclosure is reducing the cost of prototype tooling.

A stretch draw die set is used to draw a small number of prototype panels to a desired shape. As shown in FIG. 1, the stretch draw die set includes three die parts—a cavity die "C"; a binder "B"; and a punch "P." After a part is drawn it is trimmed and then flanged in a direct flange die set. As shown in FIG. 2, the direct flange die set includes three die parts—a flange post "FPT"; a flange steel "FS"; and a flange pad "FPD."

The die sets may be made from Kirksite™ a moderate strength zinc-base alloy that is easily cast to make lower cost prototype dies. However, even with the use of lower cost Kirksite™ dies, the cost of each die part adds to the cost of the tooling required to make prototype parts.

This disclosure is directed to the above problems and other problems as summarized below.

SUMMARY

According to one aspect of this disclosure, a prototype drawing/flanging tool is provided that includes a draw die set-up and a flange die set-up that share parts of the two respective die set-ups. The draw die set-up includes a binder ring, a pad; a flanging ring, and a punch. The flange die set-up includes the flanging ring, the pad, and the punch. The draw die set draws a blank and the flange die set forms a flange on the blank in two separate operations that may both be set up in the same prototype try-out press.

The pad and the flanging ring may be attached to a press in a fixed relationship when used in the draw die set-up. In the flange die set-up, the pad and the flanging ring may be attached to a press with the pad being backed by a cushion to clamp the blank against the punch while the flanging ring moves relative to the punch and pad to form the flange.

In the flange die set-up, the binder ring cooperates with the pad and the flanging ring to clamp the blank as the blank is drawn over the punch with the binder ring is spaced from the flanging ring.

The pad and the flanging ring may include a first draw bead element on the flanging ring and the binder ring may include a second draw bead element. The first draw bead element and the second draw bead element function together to retain the blank in the draw die set-up during the drawing step. The first draw bead element and the second draw bead element do not contact the blank in the flange die set-up.

The punch defines a flanging groove and the pad clamps the blank against the punch while the flange forming ring forms the flange into the flanging groove.

The pad and the flanging ring are attached to a press with fixed risers in the draw die set-up and the pad is supported by a cushion and the flanging ring is attached with fixed risers in the flange die set-up.

According to another aspect of this disclosure, a method is disclosed for making a formed/flanged part. The method begins by drawing a blank held by a pad, a flanging ring and a binder ring against a punch in a press to form a drawn blank. The drawn blank is then trimmed to form a trimmed/drawn blank. The trimmed/drawn blank is then flanged by clamped between the pad and the punch that defines a groove, with a flange forming ring forming a flange into the groove.

According to other aspects of this disclosure as it relates to the method, the pad and flanging ring are fixedly retained in the press, and a periphery of the blank is clamped against the binder ring while the blank is drawn over the punch. The blank bridges the groove while the blank is drawn over the punch.

The pad and the flanging ring may be retained in the press with the flanging ring being movable relative to the pad while the pad clamps the trimmed/drawn blank against the punch, as the flange forming ring flange forms into the flange into the groove.

The binder ring may be retained in a position spaced from the flanging ring while the flange forming ring forms the flange in the groove. The pad may be backed by a cushion while the flange forming ring forms the flange into the groove.

The method may further comprise removing the drawn blank from the press before trimming the drawn blank and returning the trimmed/drawn blank to the press. The step of trimming the drawn blank is performed by a laser cutter.

The above aspects of this disclosure and other aspects will be described in greater detail below with reference to the drawings.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
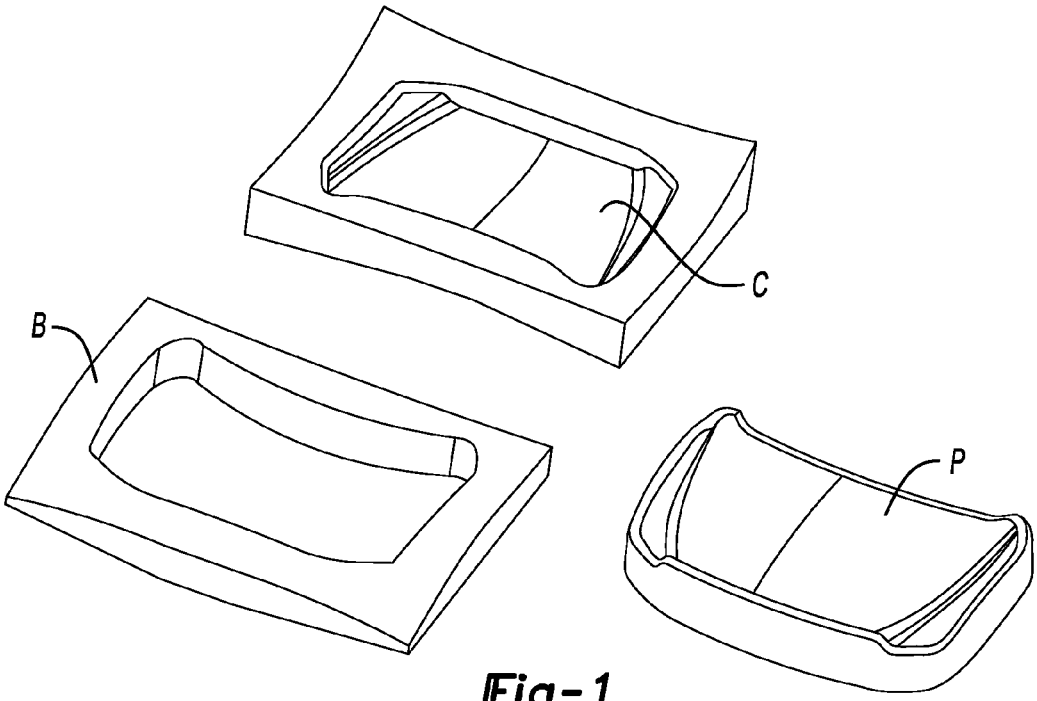
Fig-1 PRIOR ART
FIG. 1 is a perspective view of three parts of a prior art draw die for forming prototype drawn parts.
Figure 2:
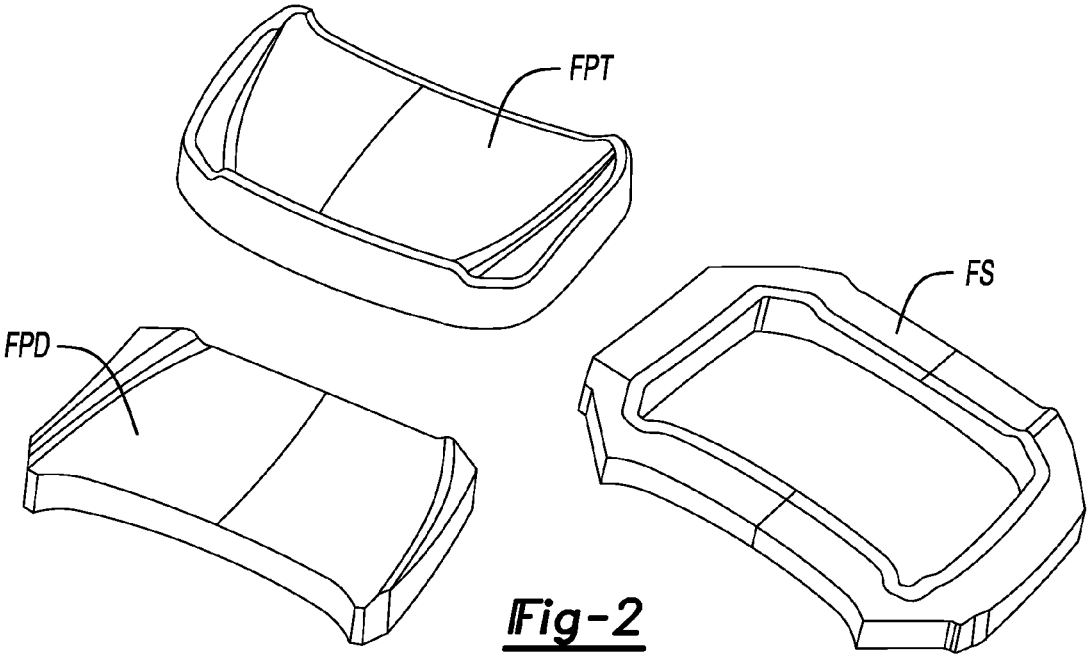
Fig-2 PRIOR ART
FIG. 2 is a perspective view of three parts of a prior art flange die for forming prototype drawn and flanged parts.
Figure 3:
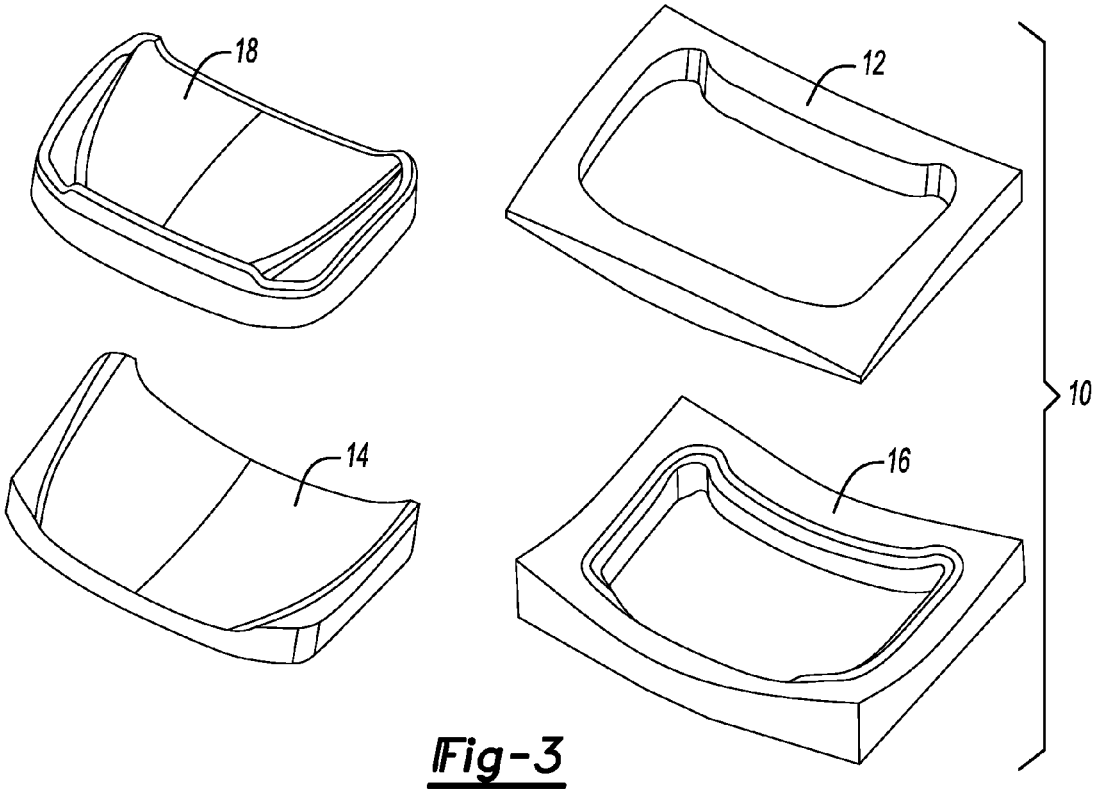
FIG. 3 is a perspective view of four parts of a drawing/flanging tool made according to this disclosure for forming prototype drawn and flanged parts.

Referring to FIG. 3, a prototype drawing/flanging tool 10 is illustrated that includes a binder ring 12, a pad 14, a flanging ring 16, and a punch 18. The four parts of the prototype drawing/flanging tool 10 can be used instead of the six parts illustrated in FIGS. 1 and 2 to form and flange a prototype part.

Figure 4:
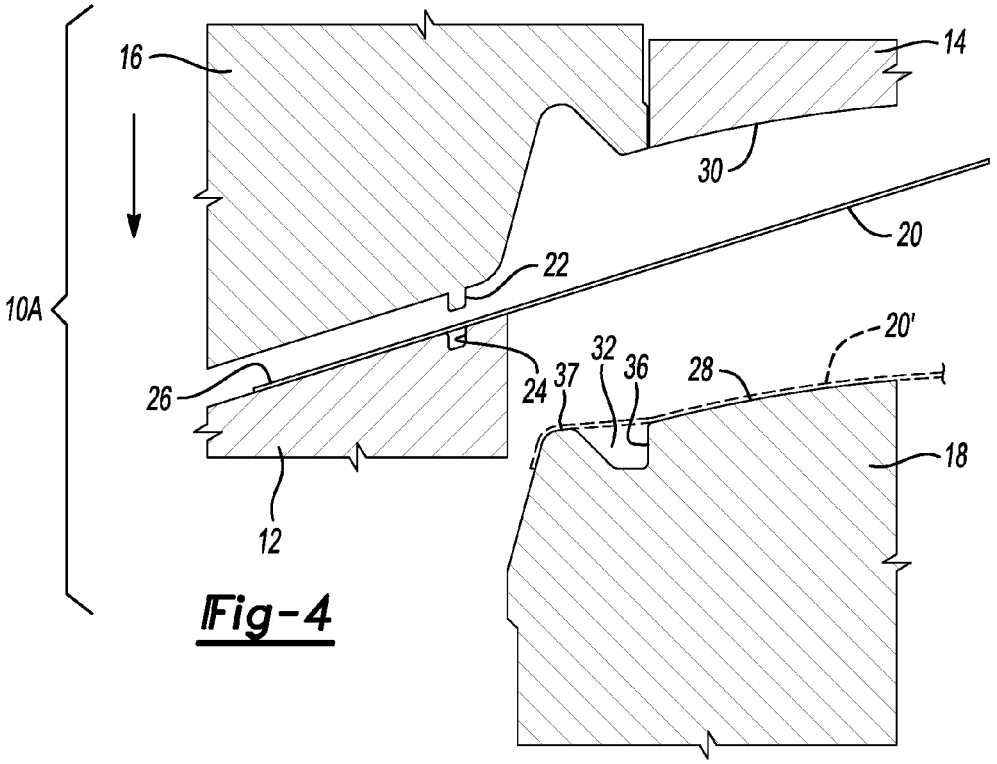
FIG. 4 is a fragmentary cross-section view of the drawing/flanging tool made according to this disclosure prior to performing the drawing operation with a drawn panel shown in phantom.

Referring to FIG. 4, the prototype drawing/flanging tool 10 is shown set-up in a draw die set-up 10A. The pad 14 and flanging ring 16 are shown above the binder ring 12 and punch 18 with a blank 20 disposed between. The pad 14 and flanging ring 16 are attached to a supporting bolster (not shown in FIG. 3) so that they are fixed relative to each other. The binder ring 12 is supported on a bolster (not shown in FIG. 3) so that the binder ring 12 is movable relative to the punch 18 in the draw die set-up.

A draw bead 22 is illustrated on the flanging ring 16 that is adapted to be received in a draw bead groove 24 defined by the binder. The draw bead 22 and draw bead groove 24 may alternatively be provided on the binder 12 and flanging ring 16. The blank 20 includes a peripheral portion 26 that is captured by the draw bead 22 on the flanging ring and the draw bead groove on the binder 12 as illustrated. The peripheral portion 26 of the blank is restrained from being pulled into the die cavity by the draw beads so that the blank 20 is stretched and drawn into the drawn shape in the die.

The punch 18 includes a draw forming surface 28 that against which the blank 20 is pulled to draw the blank into the desired drawn shape. The pad 14 includes a blank engaging surface 30 that contacts the blank 20 and moves the blank against the punch 18. A flange forming groove 32 is defined by the punch 18. A flange forming surface 36 is part of the flange forming groove 32. A flange support 37 is provided outboard of the flange forming groove 32 that supports the blank 20 outboard of the flange forming groove 32 during the drawing operation. The blank 20 bridges the flange forming groove 32 between the blank engaging surface and the flange support 37.

In operation, the prototype drawing/flanging tool 10 in the draw die set-up 10A is opened and the blank 20 is placed between the ring 12 and the pad 14 and flanging ring 16 (14 and 16 are fixed relative to each other) and the punch 18. The pad 14 and flanging ring 16 are reciprocally moved downwardly (as illustrated). The draw bead 22 captures the peripheral portion 26 of the blank 20 as the captured blank is drawn over the punch 18. The pad 14 forms the blank 20 only at the end of the drawing operation to stamp the final details in the punch 18. The drawn blank 20' is shown in phantom lines bridging the flange forming groove 32 defined by the punch 18.

Figure 5:
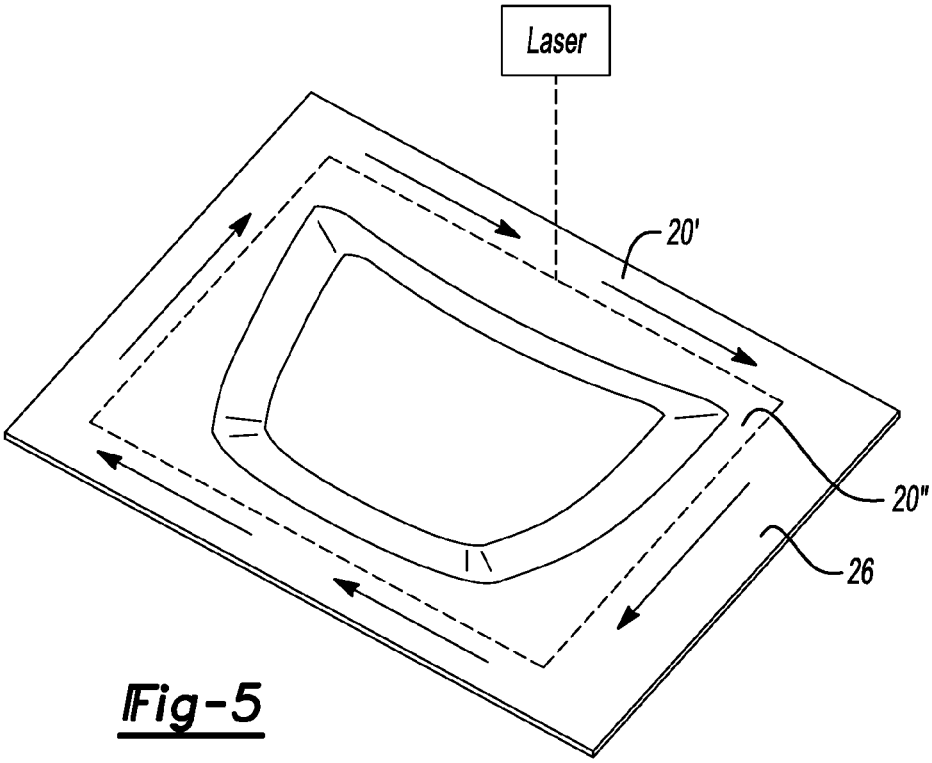
FIG. 5 is a schematic representation of a laser trimming operation performed after the drawing operation but before the flanging operation.

Referring to FIG. 5, a laser trimming operation is schematically illustrated. The drawn blank 20' is removed from the draw die set-up and placed on a supporting fixture as a laser cutting tool 38 is used to cut away the offal from the peripheral portion 26 of the drawn blank 20' to form the trimmed/drawn blank 20". The trimmed/drawn blank 20" may then be returned to the press that has been converted to the flange die set-up.

Figure 6:
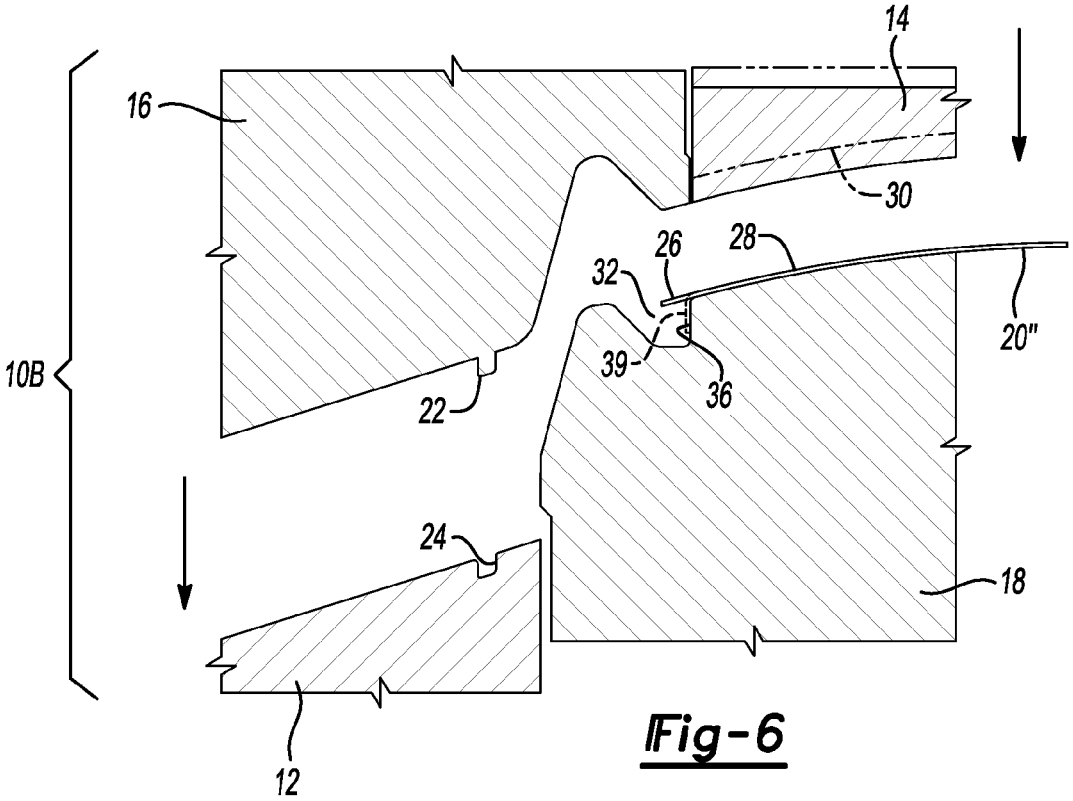
FIG. 6 is a fragmentary cross-section view of the drawing/flanging tool made according to this disclosure prior to performing the flanging operation with a drawn/trimmed panel shown before flanging.

Referring to FIG. 6, the prototype drawing/flanging tool 10 in the flange die set-up 10B is opened and the trimmed/drawn blank 20" is placed between the pad 14 and the punch 18 with a small portion of the peripheral portion of the blank extending over the flange forming groove 32. The pad 14 and flanging ring 16 are moved together until the pad 14 clamps the trimmed drawn blank 20" against the punch 18. The pad 14 is supported on a cushioning pad or cushion cylinders that allow the flanging ring 16 to continue to move toward the punch 18. The flanging ring 16 bends the small portion of the peripheral portion 26 of the trimmed/drawn blank 20" to form the flange 39 shown in phantom lines in FIG. 6 against the flange forming surface 36.

Figure 7:
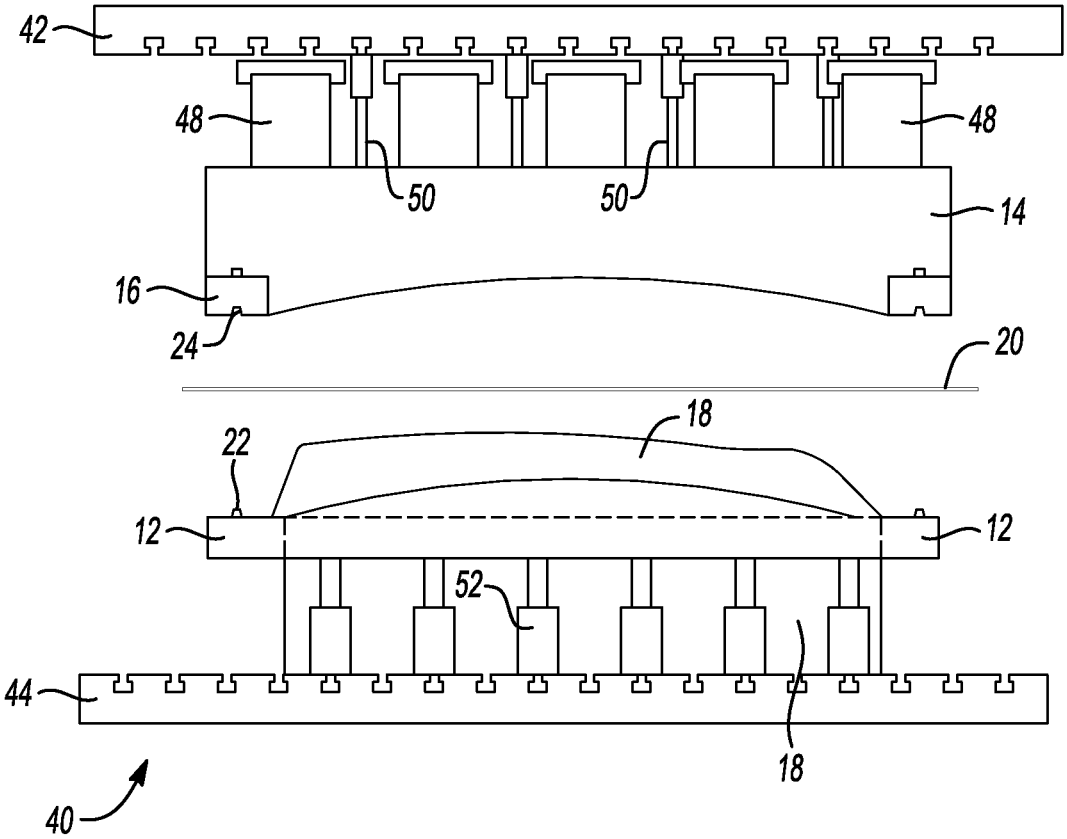
FIG. 7 is an exploded perspective view of a press with the drawing/flanging tool disposed in the press with a blank shown prior to the drawing operation.

Referring to FIG. 7, a press 40 is illustrated that includes a press ram bolster 42 and a press base bolster 44. The pad 14 and the flanging ring 16 are supported on the press ram bolster 42 by a plurality of risers and a plurality of cushion cylinders 50. In the flange die set-up 10B, the pad is supported on the cushion cylinders 50 that allow the pad 14 to clamp the trimmed/drawn blank 20" against the punch 18 while the flanging ring 16 forms the flange against the flange forming surface of the punch 18. The punch 18 is fixed relative to the press base bolster 44 either directly or on risers.

The binder ring 12 and punch are supported on the press base bolster 44. The binder ring is movably supported on binder cushion cylinders 52 that allow the binder ring to move with the flanging ring 16 in the draw die set-up 10A (as shown in FIG. 4).

The embodiments described above are specific examples that do not describe all possible forms of the disclosure. The features of the illustrated embodiments may be combined to form further embodiments of the disclosed concepts. The words used in the specification are words of description rather than limitation. The scope of the following claims is broader than the specifically disclosed embodiments and also includes modifications of the illustrated embodiments.

What is claimed is:

1. A method of making a drawn and flanged prototype part comprising:

setting a die set including a punch defining a flange forming groove in a press;

drawing a blank held by a flanging ring and a binder ring that are moved against the punch to form a drawn blank that bridges the flange forming groove;

removing the drawn blank from the die set;

trimming the drawn blank to form a trimmed/drawn blank;

replacing the trimmed/drawn blank in the die set; and flanging the trimmed/drawn blank by moving the flanging ring relative to a pad with the blank being clamped between the pad and the punch, wherein the flanging ring forms a flange into the flange forming groove.

2. The method of claim 1 wherein the pad and flanging ring are fixedly retained in the press, and wherein a periphery of the blank is clamped against the binder ring while the blank is drawn over the punch.

3. The method of claim 2 wherein the blank bridges the flange forming groove while the blank is drawn over the punch.

4. The method of claim 1 wherein the pad and the flanging ring are retained in the press with the flanging ring being movable relative to the pad while the pad clamps the trimmed/drawn blank against the punch, wherein the flanging ring forms the flange into the flange forming groove.

* * * * *